US010458663B2

(12) United States Patent
Meng et al.

(10) Patent No.: US 10,458,663 B2
(45) Date of Patent: Oct. 29, 2019

(54) AC CAGE—ANTI-THEFT DEVICE

(71) Applicants: Xianbin Meng, Tampa, FL (US); Patrick Y. Meng, Tampa, FL (US); Peter Yuanbao Meng, Tampa, FL (US)

(72) Inventors: Xianbin Meng, Tampa, FL (US); Patrick Y. Meng, Tampa, FL (US); Peter Yuanbao Meng, Tampa, FL (US)

( * ) Notice: Subject to any disclaimer, the term of this patent is extended or adjusted under 35 U.S.C. 154(b) by 253 days.

(21) Appl. No.: 15/530,466

(22) Filed: Jan. 19, 2017

(65) Prior Publication Data

US 2017/0205087 A1 Jul. 20, 2017

(30) Foreign Application Priority Data

Jan. 20, 2016 (WO) ..... PCT/CN2016/071454

(51) Int. Cl.
*F24F 1/58* (2011.01)
*E05B 73/00* (2006.01)

(52) U.S. Cl.
CPC ..... *F24F 1/58* (2013.01); *E05B 73/00* (2013.01); *F24F 2221/44* (2013.01)

(58) Field of Classification Search
CPC ..... F24F 1/58; F24F 2221/44; E04H 17/18
USPC ..... 256/25; 403/109.1–109.8
See application file for complete search history.

(56) References Cited

U.S. PATENT DOCUMENTS 4,465,262 A * 8/1984 Itri ..... E01F 13/02 160/374
5,282,606 A * 2/1994 Praiss ..... E04H 4/06 160/135
5,842,685 A * 12/1998 Purvis ..... E04G 21/3223 256/67
6,138,993 A * 10/2000 Mitchell, Jr. ..... E04H 17/163 256/25
6,725,808 B2 * 4/2004 Campbell ..... A01K 3/00 119/512
7,174,617 B2 * 2/2007 Wright ..... E04H 17/16 256/1
7,836,653 B1 * 11/2010 Herrington ..... F24F 1/58 256/25
8,596,015 B2 * 12/2013 Coon ..... E05B 73/00 248/354.1
8,677,790 B2 * 3/2014 Ramsey ..... F24F 1/56 109/49.5
D815,267 S * 4/2018 Stanton ..... D23/354
10,174,956 B2 * 1/2019 Stanton ..... F24F 1/58
2003/0146426 A1 * 8/2003 Ray ..... A01K 3/00 256/59

(Continued)

*Primary Examiner* — Joshua T Kennedy
(74) *Attorney, Agent, or Firm* — Nicholas Pfeifer; Smith & Hopen, P.A.

(57) ABSTRACT

An anti-theft device having at least three side surrounding frames in series, each having an adjustable width. The first side surrounding frame has a first free end and a second end rotatably secured to a first end of a second side surrounding frame. The second end of the second side surrounding frame is rotatably secured to a first end of a third side surrounding. The second end of the third side surrounding frame or the second end of the last side surrounding frame is a free end. When the anti-theft device is in a folded state, the at least three side surrounding frames stack on each other with the rotatably secured ends of the various side surrounding frames remaining rotatably secured to each other.

19 Claims, 7 Drawing Sheets

(56) References Cited

U.S. PATENT DOCUMENTS

2006/0180059 A1* 8/2006 Martin ..... E04H 1/1238
109/79

* cited by examiner

AC CAGE—ANTI-THEFT DEVICE

TECHNICAL FIELD

The present utility model relates to an anti-theft device.

BACKGROUND OF UTILITY MODEL

At present, an anti-theft device is usually employed for enclosing outside the outdoor unit of an air conditioner for protecting it from stealing. The anti-theft device may employ a wire entanglement, and also may employ a protect frame. But the sizes of the outdoor units of the air conditioners are different such that it is required a super high requirement for the production of the anti-theft device.

In the prior art, an anti-theft device employs a plurality of connecting rods capable of stretching out and drawing back for assembling, and changing of the length and the width of the anti-theft device is achieved by adjusting the length of the connecting rods during assembling. However, this structure needed to assemble when in use and to detach when not in use is inconvenient for use.

SUMMARY

The present utility model is intended to overcome the deficiencies of the prior art and providean anti-theft device which may be applied for anti-theft of outdoor units such as the outdoor unit of an air conditioner and the like.

To achieve the above purpose, the present utility model employs the following technical scheme:

an anti-theft device has an enclosed state and a folded state, and comprises at least three side surrounding frames capable of stretching out and drawing back along a width direction, the right edge of a side surrounding frame being rotatably connected to the left edge of a next side surrounding frame, and the left edge of the first side surrounding frame and the right edge of the last side surrounding frame being free edges, wherein when the anti-theft device is in the enclosed state, the left edge of the first side surrounding frame and the right edge of the last side surrounding frame are locked together and a closed area is formed by the side surrounding frames; when the anti-theft device is in the folded state, the at least three side surrounding frames stack on each other.

Preferably, the number of the side surrounding frames is an even number.

More preferably, the anti-theft device further comprises a transverse surrounding frame capable of stretching out and drawing back along a width direction and detachable connected to two opposite side surrounding frames when in the enclosed state.

More preferably, one of the opposite two side surrounding frames is provided with a first connecting element and the other one is provided with a lock catch, and an end of the transverse surrounding frame is provided with a second connecting element and another end is provided with a lock hook; when the transverse surrounding frame and the side surrounding frames are in a connected and locked state, the first connecting element is connected with the second connecting element, and the lock hook hooks the lock catch.

More preferably, the side surrounding frame provided with the first connecting element is provided with a stop block for preventing the first connecting element and the second connecting element from disengaging when in the connected and locked state.

More preferably, the transverse surrounding frame comprises at least two sections of transverse surrounding supports successively sleeved in the width direction.

Preferably, each of the side surrounding frames comprises at least two sections of side surrounding supports successively sleeved in the width direction.

More preferably, a disengaging prevention element is provided on the side surrounding supports for preventing the side surrounding supports sleeved together from disengaging.

Preferably, a burglar mesh is provided on the side surrounding frames.

Preferably, an upper surrounding frame is connected above the side surrounding frames capable of expanding up and down, which is able to stretch out and draw back along the width direction.

More preferably, two ends of the side surrounding frames have a hollow side support provided along the up and down direction, inside which the upper surrounding frame is slidably provided.

More preferably, a position limiting part is provided between the side surrounding supports and the upper surrounding frame for preventing the upper surrounding frame from disengaging from the side surrounding supports, and a fixing part is provided between the side surrounding supports and the upper surrounding frame for fixing the side surrounding supports and the upper surrounding frame.

Preferably, a leg is connected at the bottom of the side surrounding frames rotatable by taking the connecting point with the side surrounding frames as a turning point.

Preferably, the left edge of the first side surrounding frame is connected with a left locking edge and the right edge of the last side surrounding frame is connected with a right locking edge, and the left locking edge and the right locking edge both are provided with lockholes.

More preferably, an angled first lock sheet is horizontal provided between the left edge of the first side surrounding frame and the left locking edge, and a quadrate second lock sheet is provided between the right edge of the last side surrounding frame and the right locking edge, wherein the second lock sheet is located above or below the first lock sheet and fits closely with the first lock sheet when the left edge of the first side surrounding frame and the right edge of the last side surrounding frame are locked.

Due to the use of the above technical schemes, the present utility model has the following advantages over the prior art:

By rotatably connecting these side surrounding frames, by stretching out and enclosing these side surrounding frames when in use, and by folding them and drawing them in when not in use, the present utility model is more convenient to use than the existing anti-theft devices, and has a very simple structure.

BRIEF DESCRIPTION OF DRAWINGS

FIG. 15 is a schematic diagram of connecting of the fixing part in Embodiment 3.

DETAILED DESCRIPTION OF EMBODIMENTS

Figure 1:
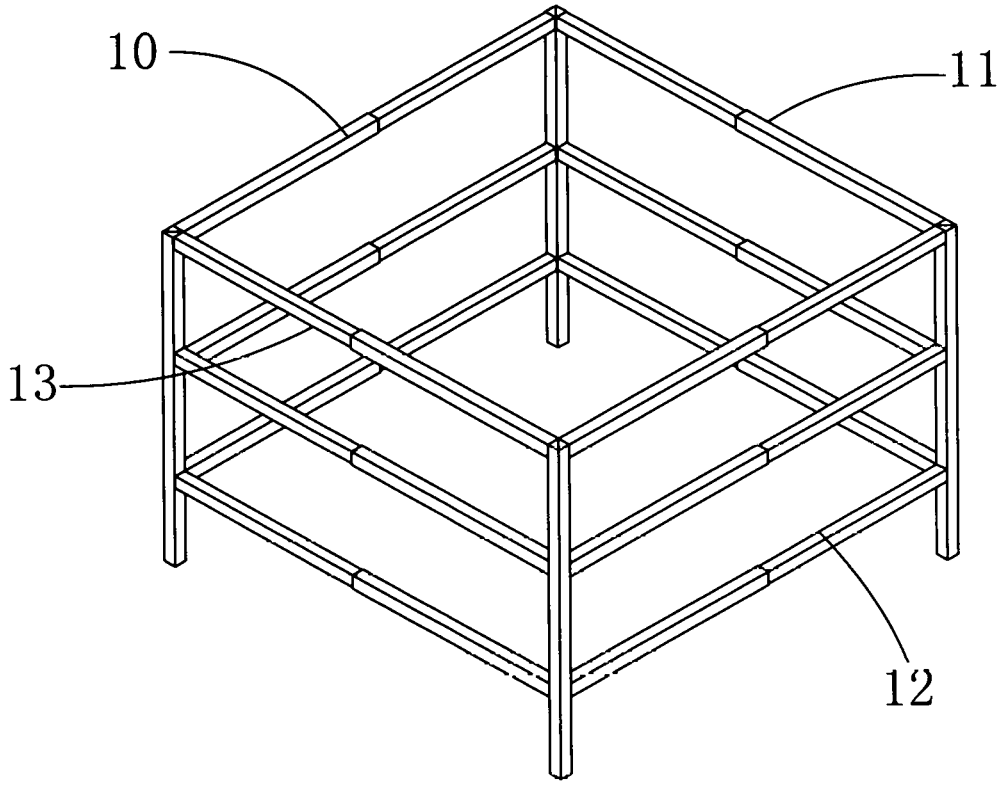
FIG. 1 is a diagram of an enclosed state of Embodiment 1.

In the following, the preferable embodiments of the present utility model are explained in detail combining with the accompanying drawings.

Embodiment 1

An anti-theft device comprises four side surrounding frames 10, 11, 12 and 13 capable of stretching out and drawing back along a width direction. The right edge of the side surrounding frame 10 and the left edge of the side surrounding frame 11 are rotatably connected, the right edge of the side surrounding frame 11 and the left edge of the side surrounding frame 12 are rotatably connected, and the right edge of the side surrounding frame 12 and the left edge of the side surrounding frame 13 are rotatably connected. The left edge of the side surrounding frame 10 and the right edge of the side surrounding frame 13 are free edges. The rotating manner between the side surrounding frames may employ a pivoting or hinging manner, and the manners capable of achieving the above-mentioned functions should be covered by the scope of the present application.

Figure 2:
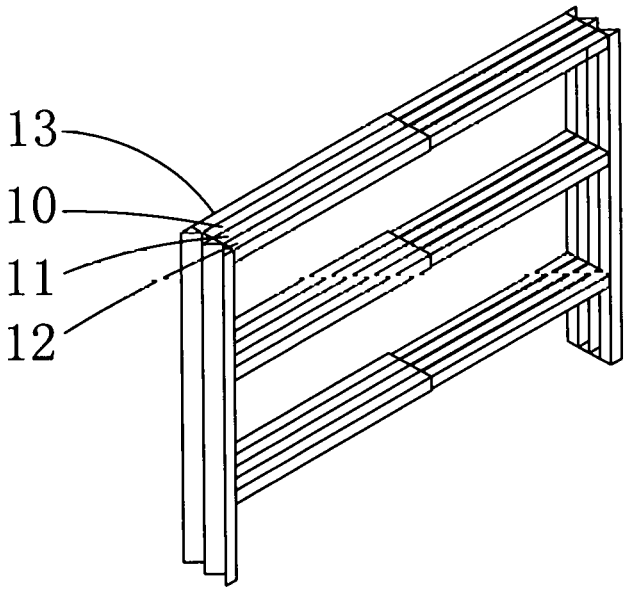
FIG. 2 is a diagram of a folded state of Embodiment 1.
Figure 3:
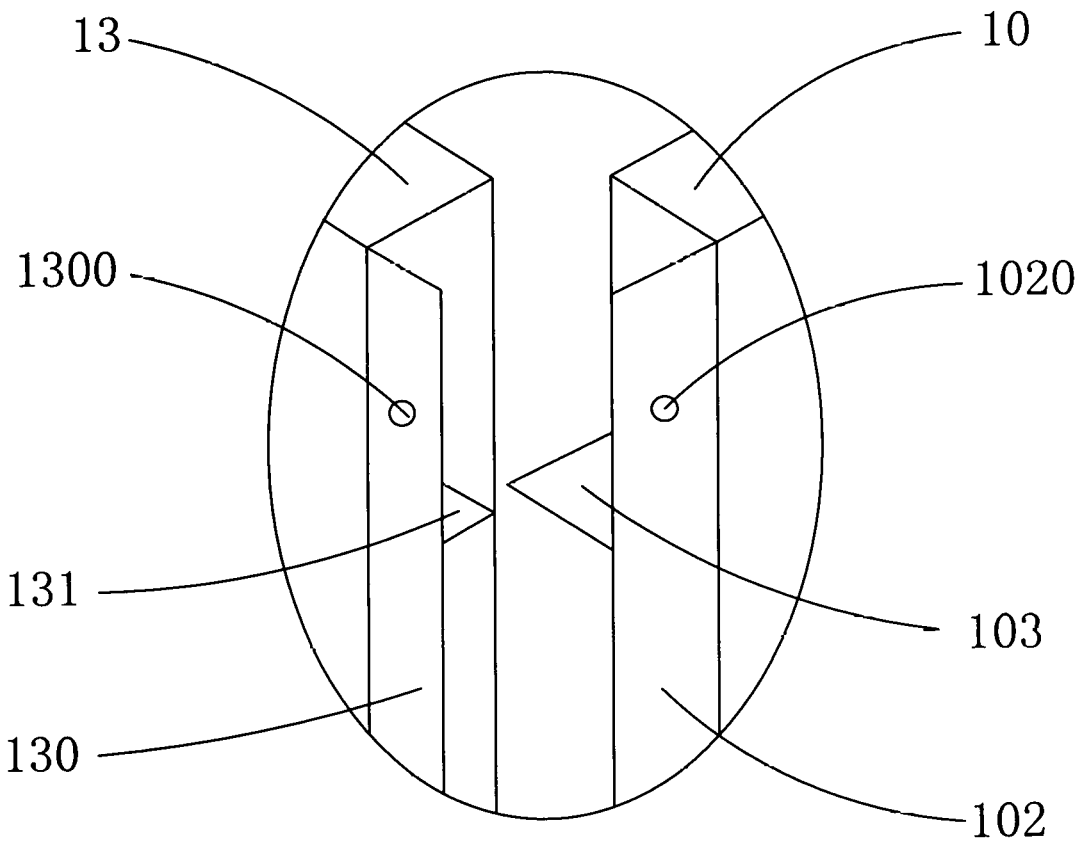
FIG. 3 is a schematic diagram of fitting of the first lock side and the second lock side in Embodiment 1.

As shown in FIGS. 1 and 2, the anti-theft device may be enclosed or folded. When need to be enclosed, the side surrounding frames 10, 11, 12 and 13 are rotated and stretched out, the left edge of the side surrounding frame 10 and the right edge of the side surrounding frame 13 are locked such that the side surrounding frames 10, 11, 12 and 13 are enclosed to form a quadrate closed area. As shown in FIG. 3, the left edge of the side surrounding frame 10 is connected with a left locking edge 102 and the right edge of the side surrounding frame 13 is connected with a right locking edge 130, and the left locking edge 102 and the right locking edge 130 both are provided with lockholes 1020 and 1030. Moreover, an angled first lock sheet 103 is provided between the left edge of the side surrounding frame 10 and the left locking edge 102, and a quadrate second lock sheet 131 is horizontally provided between the right edge of the side surrounding frame 13 and the right locking edge 130. When the left edge of the side surrounding frame 10 and the right edge of the side surrounding frame 13 are locked, the second lock sheet 131 is inserted above the first lock sheet 103 and fits closely with the first lock sheet 103 such that by locking the lockholes 1020 and 1030 together via a lock, and the first lock sheet 103 and the second lock sheet 131 fitting closely may limit the position in the up and down direction. When need to be folded, by removing the locking of the left edge of the side surrounding frame 10 and the right edge of the side surrounding frame 13, the side surrounding frames 10, 11, 12 and 13 are rotated and can folded, as shown in FIG. 2.

Figure 4:
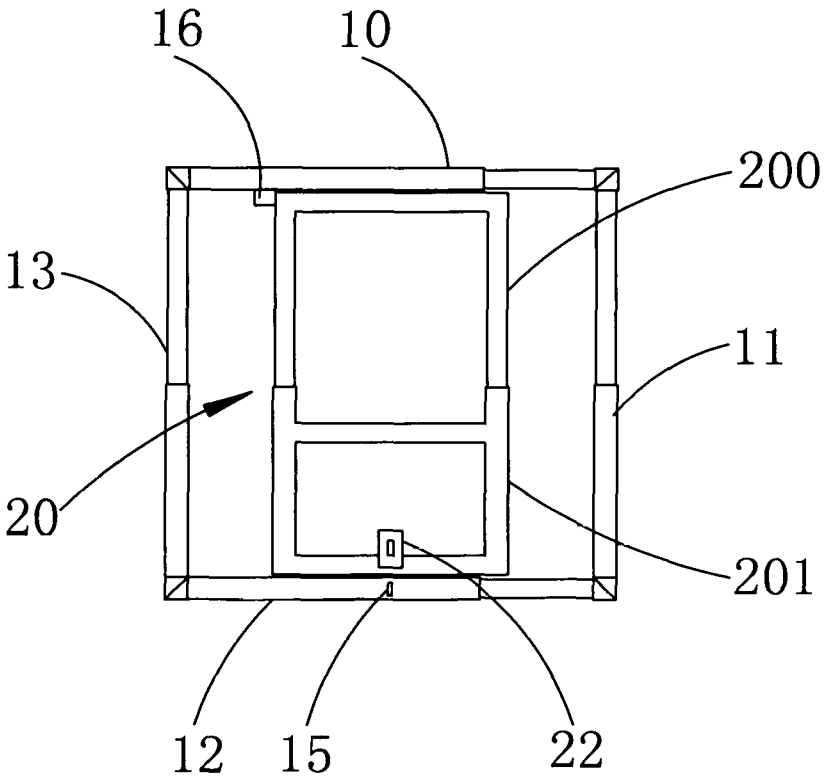
FIG. 4 is a schematic diagram of connecting of the transverse surrounding frames in Embodiment 1.
Figure 5:
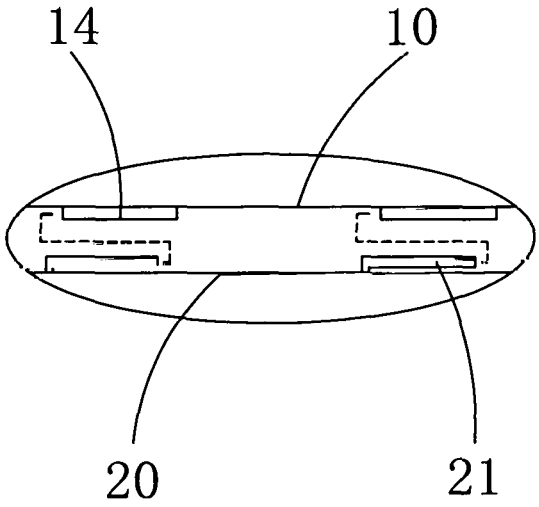
FIG. 5 is a schematic diagram of fitting relationship of the first connecting element and the second connecting element in Embodiment 1.

As shown in FIG. 4, the anti-theft device further comprises a transverse surrounding frame 20 capable of stretching out and drawing back along the width direction, which is detachable connected to two side surrounding frames 10 and 12 or side surrounding frames 11 and 13 which are opposite when in the enclosed state. Taking the side surrounding frames 10 and 12 for example, the side surrounding frame 10 is provided with a first connecting element and the side surrounding frame 12 is provided with a lock catch 15; an end of the transverse surrounding frame 20 is provided with a second connecting element and another end is provided with a lock hook 22. As shown in FIG. 5, the specific connecting manner may be that the first connecting element is a connecting hole 14, and the opening direction of the connecting hole 14 is coincident with the width direction of the side surrounding frame 10 and 12; and the second connecting element is a connecting column 21. In addition, the side surrounding frame 10 is provided with a stop block 16. During installation, the width of the transverse surrounding frame 20 is adjusted to be coincident with the width of the side surrounding frame 11 and 13, the connecting column 21 is inserted into the connecting hole 14, and the lock hook 22 hooks the lock catch 15 by rotating the transverse surrounding frame 20 and locking via a lock. At present, the stop block 16 blocks transverse surrounding frame 20 so as to prevent the connecting column 21 disengaging from the connecting hole 14.

Figure 6:
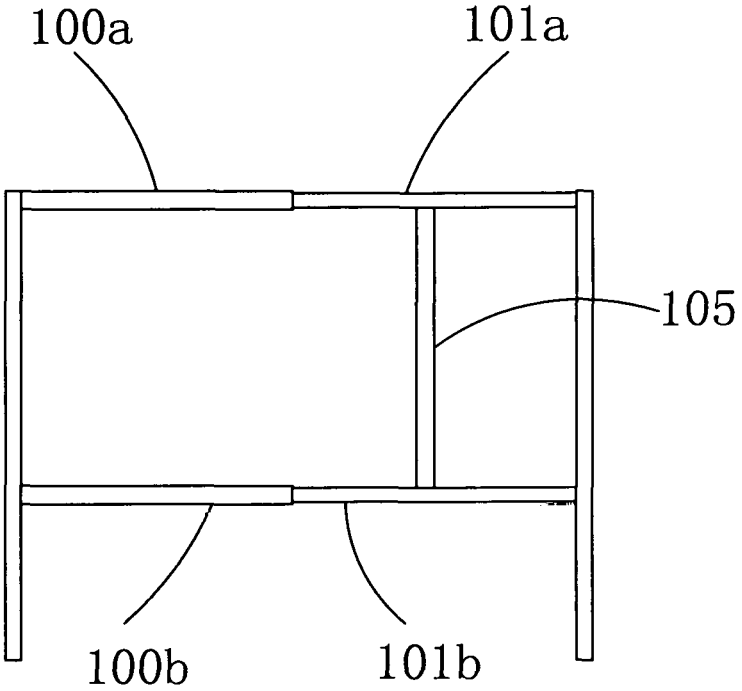
FIG. 6 is a schematic diagram of nesting of the side surrounding frames in Embodiment 1.
Figure 7:
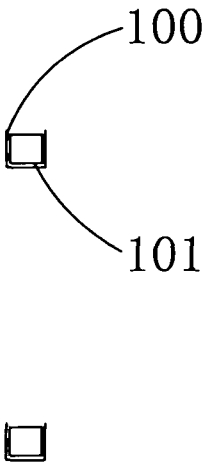
FIG. 7 is a schematic diagram of nesting of the side surrounding supports in Embodiment 1.
Figure 9:
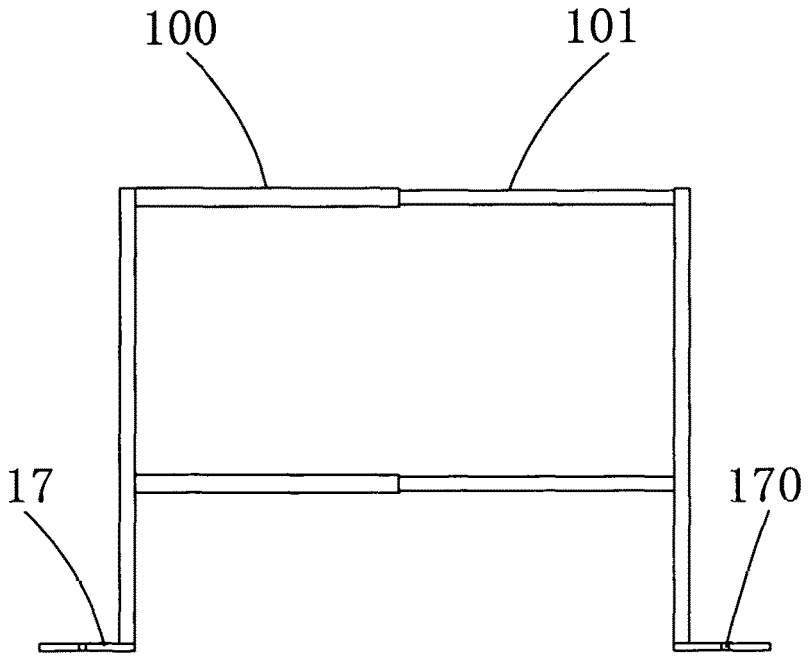
FIG. 9 is another schematic diagram of nesting of the side surrounding frames in Embodiment 1.
Figure 10:
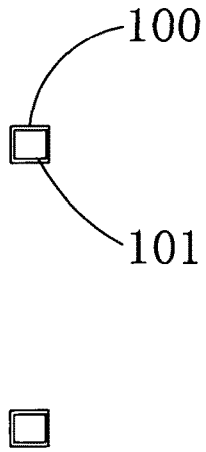
FIG. 10 is another schematic diagram of nesting of the side surrounding supports in Embodiment 1.
Figure 11:
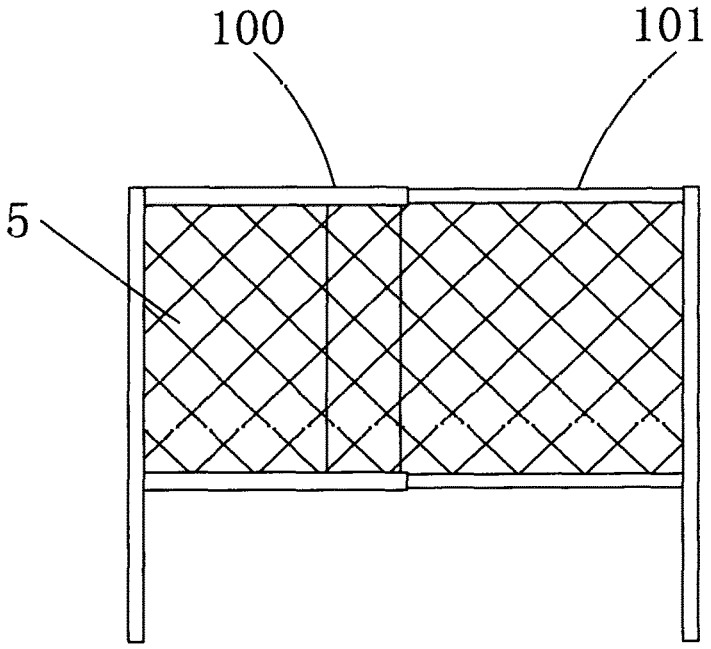
FIG. 11 is a schematic diagram of nesting of the side surrounding frames in Embodiment 2.
Figure 12:
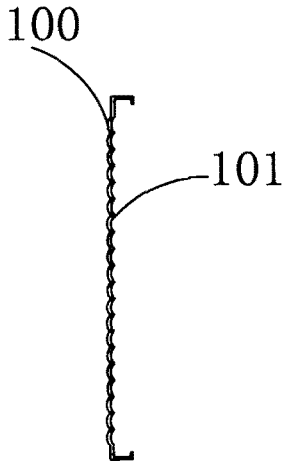
FIG. 12 is a schematic diagram of nesting of the side surrounding supports in Embodiment 2.

In this embodiment, the side surrounding frames 10, 11, 12 and 13 comprise two sections of side surrounding supports sleeved together in the width direction. Taking the side surrounding frame 10 for example, the side surrounding frame 10 comprises side surrounding supports 100*a*, 100*b*, 101*a* and 101*b*, wherein the side surrounding supports 100*a* and 100*b* are sleeved outside of the side surrounding supports 101*a* and 101*b*, and the sleeving structure may employ a tube-shaped nesting manner, the section of the structure where nesting is closed such as a hollow square shape as shown in FIGS. 9 and 10, or non-closed such as a U-shape as shown in FIGS. 6 and 7. The width of the side surrounding frames 10 is adjusted by stretching the side surrounding support 101 into the side surrounding support 100 or drawing back the side surrounding support 101. Moreover, a strengthen part 105 is provided between the side surrounding supports 100*a* and 100*b*, extending along the vertical direction.

Figure 8:
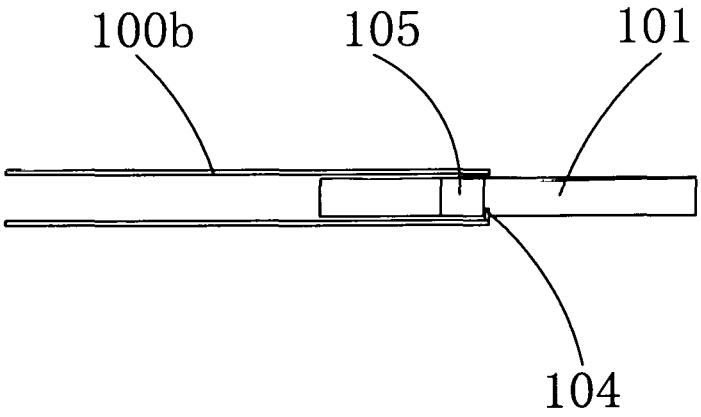
FIG. 8 is a schematic diagram of setting of the disengaging prevention element in Embodiment 1.

A disengaging prevention element is provided on the side surrounding supports for preventing the side surrounding supports sleeved together from disengaging. As shown in FIGS. 6-8, a specific embodiment of the disengaging prevention element is illustrated as follow: the side surrounding supports 100*a*, 100*b*, 101*a* and 101*b* employ a nesting manner with U-shaped section, and the strengthen part 105 is provided between the side surrounding supports 101*a* and 101*b*; a disengaging prevention hook 104 is provided at an end part of the side surrounding support 100*b* such that the side surrounding supports 101*a* and 101*b* cannot be pulled out any more when the disengaging prevention hook 104 hooks the strengthen part 105 to achieve the position limit and disengaging prevention effects. The position of the strengthen part 105 is determined by the requirement of the width when stretching out and drawing back.

Similarly, the transverse surrounding frame 20 comprises two sections of transverse surrounding supports 200 and 201 sleeved together in the width direction, which may also employ the nesting structure of the side surrounding supports 100 and 101.

Furthermore, a plurality of legs 17 is connected at the bottom of the side surrounding frames 10, 11, 12 and 13, and legs 17 may rotate by taking the connecting points with the side surrounding frames 10, 11, 12 and 13 as a turning points to increase the supporting stability. Holes 170 may be opened on legs 17 for fixing on the ground.

Embodiment 2

This embodiment is basically the same with Embodiment 1 by differing in that a burglar mesh 5 is provided on the side surrounding frames 10, 11, 12 and 13, for example a metal mesh. Similarly, the side surrounding frame 10, 11, 12 and 13 comprise two sections of side surrounding supports sleeved together in the width direction, which employ a L-shaped nesting manner due to that the tube-shaped nesting manner of Embodiment 1 is not suitable for installing a burglar mesh. Taking the side surrounding frame 10 for example, the side surrounding frame 10 comprises side surrounding supports 100 and 101, wherein the upper and lower sections of the side surrounding supports 100 and 101 are symmetrical L-shaped structures between which the burglar mesh 5 is installed, and the side surrounding supports 100 is sleeved outside the side surrounding supports 101 to implement stretching out and drawing back. Other nesting manner capable of installing the burglar mesh 5 and implementing stretching out and drawing back may also be employed.

Embodiment 3

Figure 13:
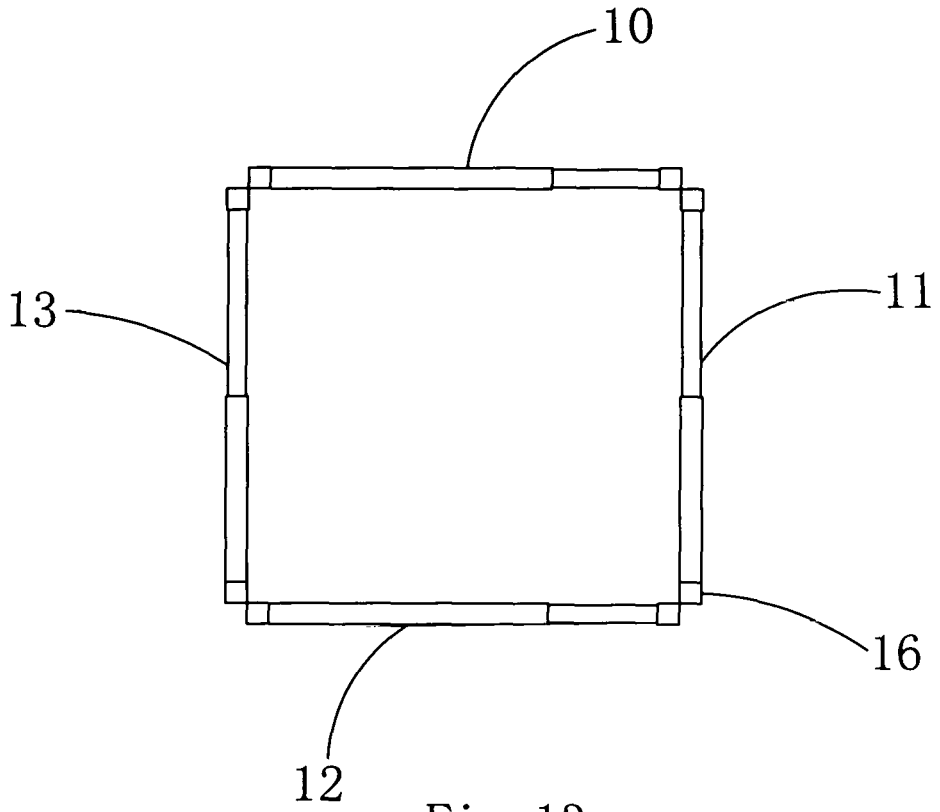
FIG. 13 is a top view of the side surrounding frames in Embodiment 3.
Figure 14:
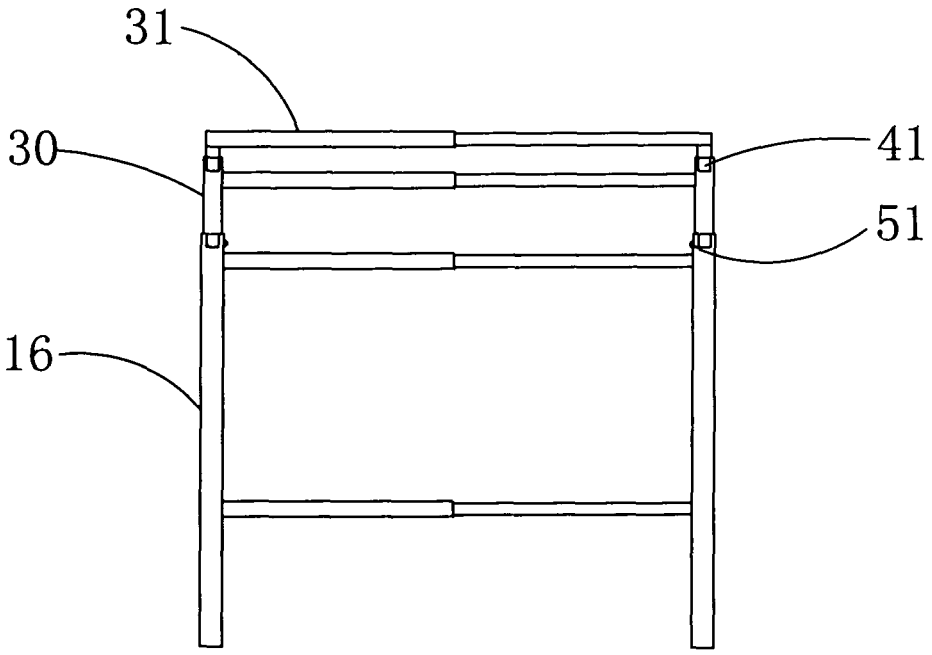
FIG. 14 is a main view of Embodiment 3.

This embodiment is substantially the same with Embodiment 1 and Embodiment 2 by differing in that, as shown in FIGS. 13 and 14, an upper surrounding frame 30 over the side surrounding frames 10, 11, 12 and 13 is connected capable of expanding up and down, which is also able to stretch out and draw back in the width direction. The upper surrounding frame 30 may also employ a tube-shaped nesting manner and the same nesting structure may be applied on the upper surrounding frame 30. The defined structure is as follow:

two ends of the side surrounding frames 10, 11, 12 and 13 have side supports 16 which are hollow along the up and down direction and inside which the upper surrounding frame 30 are slidably provided, that is, a tube-shaped nesting manner is employed.

Furthermore, between the side surrounding support 16 and the upper surrounding frame 30, a position limiting part is provided for preventing the upper surrounding frame 30 from disengaging from the side surrounding support 16, and a fixing part is provided for fixing the side surrounding support 16 and the upper surrounding frame 30.

Figure 15:
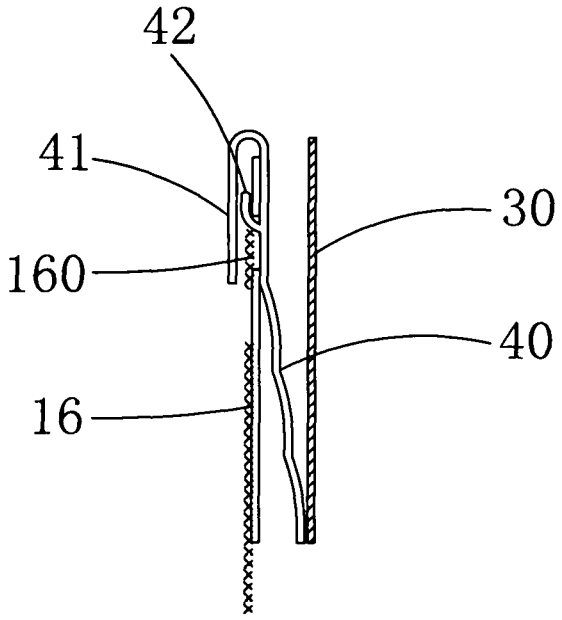
FIG. 15 is a schematic diagram of connecting of the position limiting part in Embodiment 3.

As shown in FIG. 15, the position limiting part is a limiting elastic piece having a main body 40 with a wave-shape. A bend portion 41 is formed by bending an end of the main body 40 towards one side and a tongue portion 42 is provided on the main body 40 extending towards between the main body 40 and the bend portion 41. A hole 160 is opened at an upper end part of the side surrounding support 16, and the bend portion 41 hooks the upper edge of the side surrounding support 16 such that the tongue portion 42 is stuck in the hole 160 and the wave-shaped main body 40 is located between the side surrounding support 16 and the upper surrounding frame 30. In this way, the wave-shaped main body 40 increases the friction between the side surrounding support 16 and the upper surrounding frame 30 such that the upper surrounding frame 30 is hard to disengage from the upper surrounding frame 30, and the tongue portion 42 stuck in the hole 160 may also avoid the limiting elastic piece from being taken out.

Figure 16:
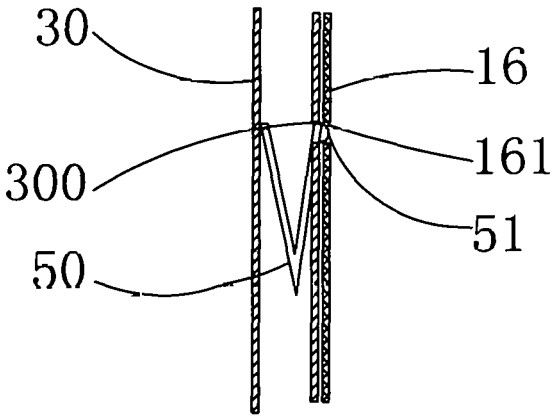

As shown in FIG. 16, the fixing part is a V-shaped elastic piece having a V-shaped main body 50, and an end part of the main body 50 have a raised portion 51 protruding outside. A hole 161 is opened on the side surrounding support 16, and a hole 300 is opened on the upper surrounding frame 30. The V-shaped main body 50 is provided inside the upper surrounding frame 30, and the raised portion 51 is stuck in the hole 300. When moving the upper surrounding frame 30, the raised portion 51 may be stuck in the hole 161 of the upper surrounding frame 30 such that the side surrounding support 16 and the upper surrounding frame 30 are fixed to each other; and when the raised portion 51 is pressed to be disengaged from the hole 161 of the upper surrounding frame 30, the side surrounding support 16 and the upper surrounding frame 30 may stretch out and draw back relative to each other.

The embodiments described above are only for illustrating the technical concepts and features of the present utility model, and intended to make those skilled in the art being able to understand the present utility model and thereby implement it, and should not be concluded to limit the protective scope of this utility model. Any equivalent variations or modifications according to the spirit of the present utility model should be covered by the protective scope of the present utility model.

What is claimed is:

1. An anti-theft device, comprising:

a plurality of sides surrounding frames arranged in a series, each of the side surrounding frames having an adjustable width;

each side surrounding fame being permanently and rotatably secured to an adjacently arranged side surrounding frame in the plurality of side surrounding frames, with the exception of a first and a last side surrounding frame;

the first side surrounding frame having a free end that is opposite an end that is permanently and rotatably secured to one of the adjacently arranged side surrounding frames;

the last side surrounding frame having a free end that is opposite an end that is permanently and rotatably secured to one of the adjacently arranged side surrounding frames;

the free end of the first side surrounding frame and the free end of the last side surrounding frame being temporarily attachable to each other; a transverse surrounding frame having an adjustable width, the transverse surrounding frame secured to a top side of at least two oppositely arranged side surrounding frames in the plurality of side surrounding frames; and the anti-theft device having an enclosed state and a folded state, when in the enclosed state, the free end of the first side surrounding frame and the free end of the last side surrounding frame are locked together and a closed-in area is formed by the plurality of side surrounding frames and the transverse surrounding provides a partial upper cover over the closed-in area, and when in the folded state, the plurality of side surrounding frames are folded and stacked on each other.

2. The anti-theft device according to claim 1, wherein the plurality of side surrounding frames includes an even number of side surrounding frames.

3. The anti-theft device according to claim 1, further including:

a top rail of one of the plurality of side surrounding frames includes a first connecting element;

a top rail of an oppositely arranged side surrounding frame includes a lock catch;

a first end of the transverse surrounding frame having a second connecting element that is adapted to engage the first connecting element;

a second end of the transverse surrounding frame having a lock hook that is adapted to engage the lock catch;

whereby the transverse surrounding frame is secured to the anti-theft device when the second connecting element engages the first connecting element and the lock hook engages the lock catch.

4. The anti-theft device according to claim 3, wherein the side surrounding frame having the first connecting element further includes a stop block for preventing the first connecting element and the second connecting element from disengaging when in a connected and locked state.

5. The anti-theft device according to claim 1, wherein the transverse surrounding frame includes at least two sections of transverse surrounding supports successively sleeved in the width direction.

6. The anti-theft device according to claim 1, wherein each of the side surrounding frames includes at least two sections of side surrounding supports successively sleeved in a width direction.

7. The anti-theft device according to claim 6, further including a disengaging prevention element provided on the side surrounding supports for preventing the side surrounding supports sleeved together from disengaging.

8. The anti-theft device according to claim 1, further including a burglar mesh provided on the side surrounding frames.

9. The anti-theft device according to claim 1, wherein each of the plurality of surrounding frames further includes an upper portion having an adjustable width and being adapted to telescope upwards and downwards from the side surrounding frame.

10. The anti-theft device according to claim 9, wherein each of the plurality of surrounding frames further includes:

a position limiting part between the side surrounding frame and the upper portion for preventing the upper portion from disengaging from the side surrounding frame; and a fixing part between the side surrounding frame and the upper portion for securing the location of the upper portion with respect to the side surrounding frame.

11. The anti-theft device according to claim 1, further including a rotatable leg connected at the bottom of one of the plurality of side surrounding frames.

12. The anti-theft device according to claim 1, wherein the free ends of the first and last surrounding side frames includes locking edges having lock holes adapted to receive a mechanical lock.

13. The anti-theft device according to claim 12, wherein the locking edges are horizontally arranged and rectangular in shape, whereby one of the locking edges can overly another locking edge.

14. An anti-theft device, comprising:

a plurality of sides surrounding frames arranged in a series, each of the side surrounding frames having an adjustable width;

each side surrounding fame being rotatably secured to an adjacently arranged side surrounding frame in the plurality of side surrounding frames, with the exception of a first and a last side surrounding frame;

the first side surrounding frame having a free end that is opposite an end that is rotatably secured to one of the adjacently arranged side surrounding frames;

the last side surrounding frame having a free end that is opposite an end that is rotatably secured to one of the adjacently arranged side surrounding frames;

the free end of the first side surrounding frame and the free end of the last side surrounding frame being temporarily attachable to each other;

a transverse surrounding frame having an adjustable width;

the anti-theft device having an enclosed state and a folded state:

when in the enclosed state:

the free end of the first side surrounding frame and the free end of the last side surrounding frame are locked together and a closed area is formed by the plurality of side surrounding frames; and the transverse surrounding frame is secured to a top side of at least two oppositely arranged side surrounding frames in the plurality of side surrounding frames, such that the transverse surrounding provides a partial upper cover of the closed area;

when in the folded state, the transverse surrounding frame is detached and the plurality of side surrounding frames are folded and stacked on each other.

15. The anti-theft device according to claim 14, further including:

a top rail of one of the plurality of side surrounding frames includes a first connecting element;

a top rail of an oppositely arranged side surrounding frame includes a lock catch;

a first end of the transverse surrounding frame having a second connecting element that is adapted to engage the first connecting element;

a second end of the transverse surrounding frame having a lock hook that is adapted to engage the lock catch;

whereby the transverse surrounding frame is secured to the anti-theft device when the second connecting element engages the first connecting element and the lock hook engages the lock catch.

16. The anti-theft device according to claim 14, wherein the side surrounding frame having the first connecting element further includes a stop block for preventing the first connecting element and the second connecting element from disengaging when in a connected and locked state.

17. The anti-theft device according to claim 14, further including a burglar mesh provided on the side surrounding frames.

18. The anti-theft device according to claim 14, wherein each of the plurality of surrounding frames further includes an upper portion having an adjustable width and being adapted to telescope upwards and downwards from the side surrounding frame.

19. An anti-theft device, comprising:

a plurality of sides surrounding frames arranged in a series, each of the side surrounding frames having an adjustable width;

each side surrounding fame being rotatably secured to an adjacently arranged side surrounding frame in the plurality of side surrounding frames, with the exception of a first and a last side surrounding frame;

the first side surrounding frame having a free end that is opposite an end that is per rotatably secured to one of the adjacently arranged side surrounding frames;

the last side surrounding frame having a free end that is opposite an end that rotatably secured to one of the adjacently arranged side surrounding frames;

the free end of the first side surrounding frame and the free end of the last side surrounding frame being temporarily attachable to each other;

each of the plurality of surrounding frames further includes an upper portion having an adjustable width and being adapted to telescope upwards and downwards from the side surrounding frame; a transverse surrounding frame having an adjustable width, the transverse surrounding frame secured to a top side of at least two oppositely arranged side surrounding frames in the plurality of side surrounding frames; and the anti-theft device having an enclosed state and a folded state, when in the enclosed state, the free end of the first side surrounding frame and the free end of the last side surrounding frame are locked together and a closed-in area is formed by the plurality of side surrounding frames and the transverse surrounding provides a partial upper cover over the closed-in area, and when in the folded state, the plurality of side surrounding frames are folded and stacked on each other.

* * * * *